US010125333B2

(12) United States Patent
D'Alencon et al.

(10) Patent No.: US 10,125,333 B2
(45) **Date of Patent: *Nov. 13, 2018**

(54) ORGANIC DISPERSION OF IRON-BASED PARTICLES IN CRYSTALLIZED FORM

(75) Inventors: Lauriane D'Alencon, Paris (FR); Julien Hernandez, Antony (FR); Virginie Harle, Senlis (FR); Michael Lallemand, Saint Denis (FR)

(73) Assignee: RHODIA OPERATIONS, Aubervilliers (FR)

( * ) Notice: Subject to any disclaimer, the term of this patent is extended or adjusted under 35 U.S.C. 154(b) by 508 days.

This patent is subject to a terminal disclaimer.

(21) Appl. No.: 13/995,798

(22) PCT Filed: Dec. 19, 2011

(86) PCT No.: PCT/EP2011/073260

§ 371 (c)(1),
(2), (4) Date: Sep. 30, 2013

(87) PCT Pub. No.: WO2012/084838

PCT Pub. Date: Jun. 28, 2012

(65) Prior Publication Data

US 2014/0013659 A1 Jan. 16, 2014

(30) Foreign Application Priority Data

Dec. 22, 2010 (FR) ..... 10 61062

(51) Int. Cl.
*C10L 1/12* (2006.01)
*C10L 10/06* (2006.01)
(Continued)

(52) U.S. Cl.
CPC ..... *C10L 10/06* (2013.01); *C10L 1/10* (2013.01); *C10L 10/02* (2013.01); *C10L 1/1608* (2013.01);
(Continued)

(58) Field of Classification Search
CPC ..... A61F 2002/065; A61F 2230/0078; A61F 2250/0039; A61F 2/07; C10L 10/02;
(Continued)

(56) References Cited

U.S. PATENT DOCUMENTS 8,232,323 B2 * 7/2012 Thompson ..... B01J 13/0047 44/354
8,641,791 B2 2/2014 Thompson
(Continued)

FOREIGN PATENT DOCUMENTS

FR 2 797 199 A1 2/2001
JP 2003-050659 2/2003
(Continued)

OTHER PUBLICATIONS

Laurent et al. "Magnetic Iron Oxide Nanoparticles: Synthesis, Stabilization, Vectorization, Physicochemical Characterizations, and Biological Applications".2008.Chem.Rev.108.pp. 2064-2110.*
(Continued)

*Primary Examiner* — Latosha Hines
(74) *Attorney, Agent, or Firm* — Young & Thompson

(57) ABSTRACT

A dispersion includes an apolar organic phase, at least one amphiphilic agent, and solid objects based on particles of an iron compound in crystallized form of small size.

19 Claims, 1 Drawing Sheet

(51) Int. Cl.

| | |
|---|---|
| ***C10L 1/10*** | (2006.01) |
| ***C10L 10/02*** | (2006.01) |
| *C10L 1/16* | (2006.01) |
| *C10L 1/188* | (2006.01) |

(52) U.S. Cl.
CPC ..... *C10L 1/1616* (2013.01); *C10L 1/1881* (2013.01); *C10L 1/1883* (2013.01)

(58) Field of Classification Search
CPC ..... C10L 10/06; C10L 1/10; C10L 1/1608; C10L 1/1616; C10L 1/1881; C10L 1/1883
USPC ..... 44/354
See application file for complete search history.

(56) References Cited

U.S. PATENT DOCUMENTS

2006/0005465 A1* 1/2006 Blanchard ..... B01J 13/003 44/602
2007/0169406 A1 7/2007 Blanchard et al.
2008/0138262 A1 6/2008 Brooks et al.
2010/0101211 A1* 4/2010 Thompson ..... C10L 1/10 60/274
2012/0192823 A1* 8/2012 Harle et al. ..... 123/1 A

FOREIGN PATENT DOCUMENTS

| | | |
|---|---|---|
| JP | 2007-509193 | 4/2007 |
| JP | 2010-522683 | 7/2010 |
| JP | 2010-522782 | 7/2010 |

OTHER PUBLICATIONS

International Search Report, dated Mar. 2, 2012, from corresponding PCT application.

* cited by examiner

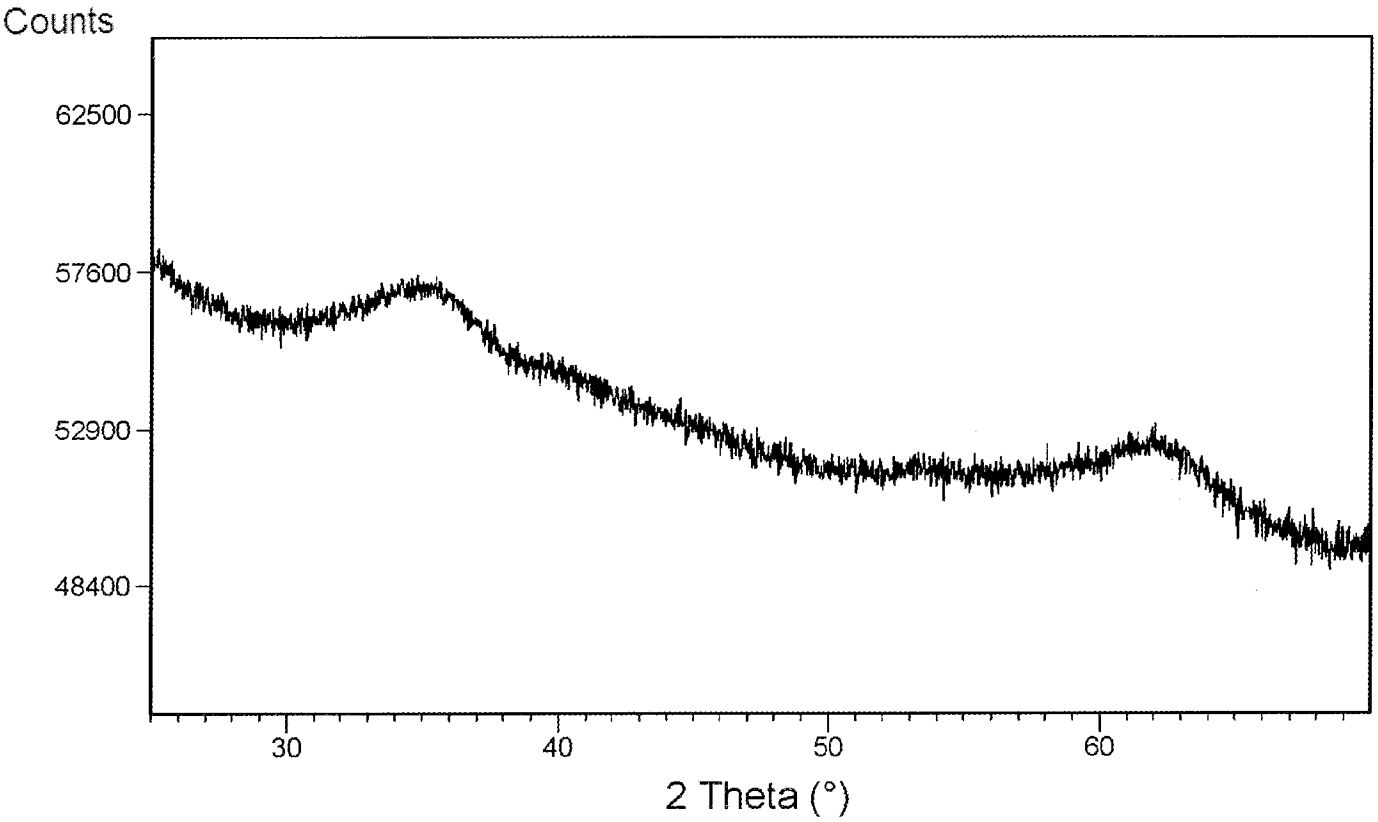
Counts
62500
57600
52900
48400
30
40
50
60
2 Theta (°)

ORGANIC DISPERSION OF IRON-BASED PARTICLES IN CRYSTALLIZED FORM

FIELD OF INVENTION

The present invention relates to organic dispersions (organosols) notably useful as a fuel additive for internal combustion engines.

BACKGROUND OF THE INVENTION

During combustion of fuel and notably of gas oil in a diesel engine, the carbonaceous products tend to form carbonaceous particles, which will be designated in the following of the description under the expression of "soots", which are said to be noxious both for the environment and for health. For a long time, there has been a search for techniques with which the emission of these soots may be reduced.

A satisfactory solution consists of introducing into the exhaust line a particle filter (or PF in the following of the text) which will block soots in its channels in order to let a gas escape without any soots. When a certain amount of accumulated soots in the PF is attained, the soots are burned in order to free the channels of the PF. This step for regenerating the PF is usually accomplished at greater temperatures than the temperature of the gas during normal operation of the engine, the soots usually burning in air at temperatures above 650° C.

In order to assist with regeneration of the PF, a catalyst is generally used which has the purpose of facilitating oxidation of the soots either directly or indirectly. By facilitating the oxidation of the soots is meant the fact of allowing their oxidation at a lower temperature so that this temperature is attained more frequently during normal operation of the engine. A portion of the soots may thus be continuously burned during the operation of the engine.

The catalyst also gives the possibility of lowering the temperature required for regenerating the PF so that the regeneration temperature is less than the combustion temperature of the soots in the absence of said catalyst. The catalyst also allows acceleration of the oxidation rate of the soots which allows a reduction in the required time for regenerating the PF.

Among fuel additives for assisting with regeneration of the PF, dispersions of rare earths, notably based on cerium are known for being efficient for regenerating the PF and contribute to the reduction of the self-ignition temperature of the soots or of the oxidation temperature.

Dispersions of iron compounds used as an additive of fuels may contribute to the reduction of this oxidation temperature of the soots.

It is thus sought to obtain dispersions having good dispersibility, high stability over time and further good compatibility in the medium into which they are introduced, and preferably sufficient catalytic activity at a relatively not very high concentration.

SUMMARY OF THE INVENTION

An object of the invention is to provide a dispersion adapted to this type of use.

For this purpose, the invention proposes colloidal dispersions comprising particles, most of them not being aggregated together, and having good monodispersity.

More specifically, a dispersion according to the invention comprises:

an apolar organic phase;

at least one amphiphilic agent, and solid objects dispersed in the organic phase as individualized particles or particle aggregates, consisting of an iron compound in crystallized form, such that:

said solid objects have a hydrodynamic diameter $D_h$ less than or equal to 30 nm as measured by dynamic light scattering (DLS);

said particles have an average size $\overline{D}_{XRD}$ of less than or equal to 7 nm as measured by X-ray diffraction (XRD); and at least 80% by number of said particles have a size $D_{TEM}$ of less than or equal to 7 nm as measured by transmission electron microscopy (TEM).

The solid objects dispersed in the dispersions of the invention are individualized solid particles or aggregates of such particles. Said particles may further optionally contain residual amounts of bound or adsorbed ions such as for example sodium ions or ammonium ions.

The invention also relates, according to another aspect, to a method for preparing a dispersion according to the invention, comprising the following steps:

a) putting into contact in an aqueous phase, a base and a mixture comprising a Fe(II) salt and a Fe(III) salt, according to a molar ratio Fe(II)/Fe(III) comprised from 0.45 to 0.55, preferably about equal to 0.5, advantageously equal to 0.5, by maintaining the pH of the aqueous phase at a pH value of more than 11.5, whereby a precipitate is obtained; and b) putting into contact the thereby obtained precipitate, optionally separated from the aqueous phase, with an organic phase based on an apolar solvent, in the presence of amphiphilic agent, whereby the dispersion is obtained in an organic phase.

The dispersion of the invention has the advantage of being very stable. The particles of the dispersion of the invention do not settle and the dispersions do not decant, even after several months. Further, it may have good compatibility with fuels of the gasoil type, notably based on biofuels.

According to a preferred alternative, it may further have high catalytic activity.

BRIEF DESCRIPTION OF THE DRAWINGS

FIG. 1 corresponds to the diffractogram of the dispersion of iron particles in a crystallized form (according to invention) as prepared in Example 1.

DETAILED DESCRIPTION OF THE INVENTION

The dispersion of the invention is an apolar organic phase dispersion.

For this purpose, most often, the organic phase consists of at least 80%, preferably at least 90%, preferably at least 95% by mass of an apolar solvent or of a mixture of apolar solvents, based on the total mass of the organic phase.

The apolar organic phase optionally consists only of an apolar solvent or of a mixture of apolar solvents.

This organic phase is notably selected depending on the use of the dispersion. By «apolar solvent», is meant a solvent having very low affinity for water and a relatively low miscibility in water. Generally, an apolar solvent is a solvent for which the resulting dipolar moment is zero. This may therefore be a molecule not including any polar group (such as for example cyclohexane) or a molecule including polar groups but for which the geometry ensures that the dipolar moment is cancelled out (such as carbon tetrachloride for example).

The apolar organic phase is preferably based on an apolar hydrocarbon or on a mixture of apolar hydrocarbons, and it preferably comprises at least 70%, preferably at least 80%, preferentially at least 90%, advantageously at least 95% by mass of an apolar hydrocarbon or of a mixture of apolar hydrocarbons.

The apolar organic phase typically only consists of a hydrocarbon of a mixture of apolar hydrocarbons.

As an example of an apolar organic phase, mention may be made of aliphatic hydrocarbons like hexane, heptane, octane, nonane, cycloaliphatic hydrocarbons such as cyclohexane, cyclopentane, cycloheptane. Petroleum cuts of the Isopar type essentially containing isoparaffinic and paraffinic $C_{11}$ and $C_{12}$ hydrocarbons are also suitable.

It is also possible to apply chlorinated hydrocarbons for the apolar organic phase.

The apolar organic phase may be based on a mixture of two or several apolar hydrocarbons of the type described above.

The dispersion according to the invention includes at least one amphiphilic agent.

This amphiphilic agent has the effect of stabilizing the particle dispersion. It is also used as a phase transfer agent during the preparation of the dispersions (between the aqueous phase and the organic phase).

Preferably, the amphiphilic agent is a carboxylic acid which generally includes from 10 to 50 carbon atoms, preferably from 10 to 25 carbon atoms.

This acid may be linear or branched. It may be selected from aryl, aliphatic or arylaliphatic acids, optionally bearing other functions provided that these functions are stable in the media in which the dispersions according to the present invention are desirably used.

Thus, it is possible for example to apply aliphatic carboxylic acids whether they are natural or synthetic. Of course it is possible to use acids in a mixture.

As an example, mention may be made of fatty acids of tallol, soya bean, tallow oil, flax oil, oleic acid, linoleic acid, stearic acid and its isomers, pelargonic acid, capric acid, lauric acid, myristic acid, dodecylbenzenesulfonic acid, ethyl-2-hexanoic acid, naphthenic acid, hexanoic acid.

As a preferred amphiphilic agent, mention may be made of stearic acid and of its isomers such as for example a mixture of acids or products which contain chain length distributions like Prisorine 3501 from Croda.

This amphiphilic agent may also be composed of one or several polyacids such as succinic acids substituted with polybutenyl groups. These polyacids may be used alone or in combination with one or several aliphatic monocarboxylic acids containing between 10 and 20 carbon atoms on average.

As an example, mention may be made of the mixture of oleic acid with one or several succinic acids substituted with polybutenyl groups, in which the polybutenyl groups have an average molecular weight (measured by gas chromatography) comprised between 500 and 1,300 and more particularly between 700 and 1,000 $g \cdot mol^{-1}$.

According to a feature of the invention, the particles of the dispersion of the invention are based on an iron compound in crystallized form.

This crystallized form, which may be obtained by applying the steps of the aforementioned method, may notably be observed with the X-ray diffraction technique (XRD) which shows characteristic peaks of at least one defined crystallized structure of iron.

The solid objects of the dispersion of the invention are in the form of particles or particle aggregates of an iron compound of which the composition essentially corresponds to an iron oxide in crystallized form.

The crystallized forms of the iron oxide making up the particles according to the invention are typically Fe(III) oxides of the maghemite type ($\gamma$-$Fe_2O_3$) and/or Fe(II) and Fe(III) oxides of the magnetite type ($Fe_3O_4$).

The aforementioned method generally gives the possibility of obtaining particles based on Fe(III) oxide of the maghemite type and/or of Fe(II) and Fe(III) oxide of the magnetite type, the magnetite may then be oxidized into Fe(III) oxide of the maghemite type, for example upon contact with oxygen.

Preferably, the particles with a size greater than or equal to 4 nm in the dispersion are for at least 90% of them, in the form of an iron compound in a crystallized form, advantageously at least 95%, preferentially at least 99%.

According to another feature of the invention, the average size $\overline{D}_{XRD}$ measured by XRD of the particles of the dispersion is less than or equal to 7 nm, preferably less than or equal to 6 nm, preferentially less than or equal to 5 nm.

Generally this size is of at least 4 nm.

The crystallized nature of the particles according to the invention may notably be detected by XRD analysis. The XRD diagram allows the definition of two characteristics of these particles:

- the nature of the crystalline phase: the position of the measured diffraction peaks as well as their relative intensity are characteristic of the magnetite or maghemite phase, the crystalline phase then corresponding to the sheet ICDD 01-088-0315; and
- the average size $\overline{D}_{XRD}$ of crystallites (or crystallized domains), this size is calculated from the width at half-height of the diffraction peak of the crystallographic plane (440) of maghemite/magnetite::

$$\overline{D}_{XRD} = \frac{k \cdot \lambda}{\sqrt{H^2 - s^2} \cdot \cos\theta}$$

with:

$\lambda$: wavelength=1.54 Å, k: form factor equal to 0.89,

H: total width at half-height of the relevant line, expressed in degrees, s: instrumental width at the angle $\theta$ as determined by $LaB_6$ analysis=0.072°, $\theta$ diffraction angle (in radians) of the diffraction peak (440) of magnetite and/or maghemite=0.547 rad.

The XRD analysis may for example be carried out on a commercial apparatus of the X'Pert PRO MPD PANalytical type, notably composed of a $\theta$-$\theta$ goniometer, allowing characterization of liquid samples. The sample remains horizontal during the acquisition and it is the source and the detector which move.

This installation is driven by the X'Pert Datacollector software package provided by the supplier and utilization of the obtained diffraction diagrams may be performed by means of the X'Pert HighScore Plus software package, version 2.0 or above (supplier: PANalytical).

The dispersion state of the solid objects may be characterized by dynamic light scattering (DLS), further called quasi-elastic light scattering (QELS), or further photon correlation spectroscopy. This technique allows measurement of a hydrodynamic diameter $D_h$ of the solid objects for which the value is very strongly affected by the presence of particle aggregates.

According to another feature of the invention, the solid objects of the invention have a hydrodynamic diameter $D_h$ of less than or equal to 30 nm, preferably less than or equal to 20 nm, preferentially less than or equal to 16 nm, as measured by dynamic light scattering (DLS).

The hydrodynamic diameter $D_h$ of the solid objects of a dispersion according to the invention may be measured on the dispersion of the invention, after diluting the latter by its solvent so as to attain an iron concentration comprised from 1 to 4 $g \cdot L^{-1}$.

It is possible to use a light scattering apparatus of the ALV CGS 3 (Malvern) type provided with an ALV series 5000 correlator and with ALV correlator software, V3.0 or above. This apparatus uses the data processing method said to be the method of the «Koppel cumulants», which gives the possibility of accessing the value of the hydrodynamic diameter $D_h$.

It is important to perform the measurement at the temperature (typically 25° C.) corresponding to the values of viscosity and of refractive index used for the solvents in the calculation of the hydrodynamic diameter and to use a measurement angle typically set to 90°.

It is also recommended to carry out the preparations of the dilution as well as the handling operations under a hood with laminar flow in order to avoid contamination of the samples by dusts and distortion of the measurement.

It is considered that the experimental data are validated if the scattered intensity is stable and if the autocorrelation function is without any abnormalities.

Finally, the scattered intensity should be comprised within defined limits for each apparatus.

This feature of the objects of the dispersion contributes to its stability. The individualized nature of the particles also increases the overall contact surface area available between the latter and the soots and thus contributes to the improvement in the catalytic activity of the dispersion according to the invention.

According to another feature of the invention, it is preferable that the major part of the particles, i.e. at least 80% by number, have a size $D_{TEM}$ of less than or equal to 7 nm, more particularly less than or equal to 6 nm.

Typically, at least 90% and more particularly at least 95% of the particles have a size $D_{TEM}$ of less than or equal to the aforementioned values.

This size $D_{TEM}$ may be detected by analyzing the dispersion with transmission electron microscopy (TEM), used in an imaging mode giving the possibility of viewing the particles at a strong magnification and of measuring their size.

Preferably and for better accuracy of the measurement of the size of the particles, it is possible to proceed according to the following procedure.

The dispersion according to the invention is diluted beforehand by its solvent so as to attain an iron mass content of about 0.035%. The thereby diluted dispersion is then positioned on an observation grid (such as a carbonaceous polymeric membrane supported on a copper grid), and the solvent is evaporated.

For example it is possible to use a transmission electron microscope giving access to magnifications ranging up to 800,000, the acceleration voltage being preferably selected equal to 120 kV.

The principle of the method consists of examining under the microscope different regions (about 10) and of measuring the dimensions of 250 particles, by considering these particles as spherical particles. A particle is estimated as being identifiable when at least half of its perimeter may be defined. The size $D_{TEM}$ then corresponds to the diameter of the circle properly reproducing the circumference of the particle. The identification of the particles which may be utilized may be accomplished by means of a software package such as Imagej, Adobe Photoshop or Analysis.

A cumulated grain size distribution of the particles is inferred therefrom, which are grouped into 40 grain size classes ranging from 0 to 20 nm, the width of each class being of 0.5 nm. The number of particles in each class or for each $D_{TEM}$ is the basic datum for illustrating the number differential grain size distribution.

Moreover, the particles of the dispersion of the invention have a fine grain size as observed with TEM.

They have a median diameter $\Phi_{50}$ preferably comprised between 2 nm and 6 nm, more particularly between 3 nm and 5 nm.

The number median diameter $\Phi_{50}$ is the diameter such that 50% of the counted particles on the TEM micrographs have a smaller diameter than this value, and 50% of the counted particles have a larger diameter than this value.

The particles according to the invention generally have a polydispersity index $P_n$ comprised from 0.1 to 0.5.

This polydispersity index $P_n$ is calculated from the number grain size distribution determined by TEM according to the following formula:

$$P_n = \frac{\Phi_{84} - \Phi_{16}}{2 \cdot \Phi_{50}}$$

$\Phi_{16}$ being the diameter for which 16% of the particles have a diameter of less than this value, and $\Phi_{84}$ being the diameter for which 84% of the particles have a diameter of less than this value.

This measurement reflects the fact that the particles according to the invention have good monodispersity.

The dispersions according to the invention may further comprise in the apolar organic phase, particles of an iron compound in amorphous form, notably particles for which the size is greater than or equal to 4 nm.

The amorphous nature of an iron compound may be detected by XRD analysis of this compound, when no characteristic peak of any crystalline phase of iron is observed.

Preferably, the particles of an iron compound in amorphous form represent at most 75% by number of the total amount of iron particles of the dispersion.

For particles with a size greater than or equal to 4 nm, the particles of an iron compound in amorphous form represents at most 50% by number of the total amount of iron particles with a size greater than or equal to 4 nm, and preferably at most 40% by number.

The dispersions according to the invention have a mass concentration of the iron compound which may be of at least 2%, more particularly of at least 5%, this concentration being expressed in the mass of iron metal relatively to the total mass of the dispersion.

This concentration may generally range up to 20%.

The iron content may be determined by any technique known to one skilled in the art such as by the measurement with X fluorescence spectroscopy directly applied onto the dispersion according to the invention.

The present invention also relates to a method for preparing the dispersions of the invention.

In step a) of the method, a base and a mixture comprising an Fe(II) salt and an Fe(III) salt according to a molar ratio (Fe(II)/Fe(III) comprised from 0.45 to 0.55, preferably about equal to 0.5, advantageously equal to 0.5, are put into contact in an aqueous phase, typically an aqueous solution of the base and of the iron salts.

As a base, it is possible to notably use compounds of the hydroxide type. Mention may be made of alkaline or earth alkaline hydroxides and ammonia. It is also possible to use secondary, tertiary or quaternary amines.

As an iron salt, it is possible to use any water-soluble salt. As an Fe(II) salt, mention may be made of ferrous chloride $FeCl_2$. As an Fe(III) salt, mention may be made of ferric nitrate $Fe(NO_3)_3$.

During step a), the reaction occurring between the Fe(II) salt, the Fe(III) salt and the base is generally accomplished under conditions such that the pH of the formed reaction mixture remains greater than or equal to 11.5 upon putting into contact the iron salts and the base in the reaction medium.

Preferably, during step a), the pH of the reaction mixture is maintained at a value greater than or equal to 12. This pH value is typically comprised between 12 and 13.

The putting into contact of the iron salts and of the base in an aqueous phase may be accomplished by introducing a solution of the iron salts into a solution containing the base, for which the pH is of at least 11.5. It is also possible to introduce the iron salt and the base in a solution containing salts, at a concentration typically less or equal to 3 $mol \cdot L^{-1}$, such as for example sodium nitrate, and for which the pH is adjusted beforehand to a value greater than or equal to 11.5. It is possible to continuously achieve the contacting, the pH condition being fulfilled by adjusting the respective flow rates of the solution of the iron salts and of the solution containing the base.

It is possible, according to a preferred embodiment of the invention to operate under conditions such that during the reaction between the iron salts and the base, the pH of the aqueous phase is maintained constant. By maintaining the pH constant, is meant a variation of the pH of ±0.2 pH units relatively to the set value. Such conditions may be obtained by addition during the reaction between the iron salts and the base, for example upon introducing the solution of the iron salts into the solution of the base, and an additional amount of base into the aqueous phase.

Within the scope of the present invention, the inventors have observed that the size of the particles may be modulated depending on the pH at which is maintained the aqueous phase. Typically, and without intending to be bound to a particular theory, the size of the particles is all the smaller since the pH of the aqueous phase is high.

The reaction of step a) is generally conducted at room temperature. This reaction may advantageously be conducted under an air or nitrogen or nitrogen-air mixture atmosphere.

At the end of the reaction of step a), a precipitate is obtained, suspended in the aqueous phase. It is optionally possible to subject the precipitate to ripening by maintaining it for a certain time, for example a few hours, in the aqueous phase.

According to a first advantageous alternative of the method according to the invention, the precipitate is not separated from the aqueous phase at the end of step a) and is left suspended in the aqueous phase of the reaction of step a).

According to another alternative of the method according to the invention, the method comprises, after step a) and before step b), a step a) for separating the precipitate formed at the end of step a) from the aqueous phase.

This separation step a) is carried out by any known means.

The separated precipitate may then be washed with water for example. Preferably, the precipitate is not subject to any drying or freeze-drying step or any operation of this type.

The precipitate may optionally be resuspended in a second aqueous phase.

In order to obtain a dispersion in an organic phase, during step b), the precipitate obtained at the end of step a), whether it is separated from the aqueous phase or not, is put into contact with the apolar organic phase in which the dispersion is desirably obtained.

This apolar organic phase is of the type which has been described above.

The contacting of step b) is accomplished in the presence of the aforementioned amphiphilic agent, optionally after neutralization of the suspension obtained at the end of step a).

Preferably, the molar ratio between the number of moles of amphiphilic agent and the number of moles of iron is from 0.2 to 1, preferentially from 0.2 to 0.8.

The amount of apolar organic phase to be incorporated is adjusted so as to obtain an oxide concentration as mentioned above.

The order of the introduction during step b) of the different elements of the dispersion is indifferent.

It is possible to put into contact the obtained precipitate, the amphiphilic agent and the apolar organic phase, simultaneously.

It is also possible to produce the premix of the amphiphilic agent and of the apolar organic phase.

The contacting between the precipitate and the apolar organic phase may be accomplished in a reactor which is under an air, nitrogen or air-nitrogen mixture atmosphere.

Although the contact between the precipitate and the apolar organic phase may be accomplished at room temperature, about 20° C., it is preferably to operate at a temperature selected in a range from 30° C. to 150° C., advantageously between 40° C. and 100° C.

In certain cases, due to the volatility of the apolar organic phase, its vapors should be condensed by cooling it down to a temperature below its boiling point.

The reaction mixture resulting from the precipitate, from the apolar organic phase and from the amphiphilic agent is maintained with stirring during the whole duration of the heating.

In the case of the first alternative where the precipitate has not been separated from the aqueous phase at the end of step a), when the heating is stopped, the presence of two new phases is noted: an apolar organic phase containing the dispersion of particles, and a residual aqueous phase. The apolar organic phase is then separated, containing the dispersion of particles and the residual aqueous phase according to conventional separation techniques, such as for example decantation or centrifugation.

Regardless of the alternative of the method, according to present invention, organic dispersions are obtained at the end of step b), which have the aforementioned features.

The dispersions further comprising particles of an iron compound in amorphous form may be obtained by mixing a first dispersion of particles of an iron compound in amorphous form in an organic phase with a second dispersion of particles of an iron compound in crystallized form, this second dispersion being of the type according to the invention.

As a first dispersion of particles of an iron compound in amorphous form those described in WO 2003/053560 for example may be used.

Dispersions for which the organic phases are identical are preferably mixed.

The organic dispersions which have just been described may notably be used as fuel additives for internal combustion engines, more particularly as gas oil additives for diesel engines or as gasoline additives for certain gasoline engines emitting soots or carbonaceous particles.

They may more generally be used as combustion additives in combustible materials or liquid fuels of energy generators such as internal combustion engines (positive ignition engines), electric generating sets, oil burners, or jet propulsion engines.

The invention also relates to an additive fuel comprising a fuel for internal combustion engines and a dispersion of the type of the one which has been described above or obtained by the method described earlier. This additive fuel is obtained by mixing a fuel with the dispersion of the invention.

The fuels suitable for preparing an additive fuel according to the present invention notably comprise commercially available fuels and in certain embodiments, all the commercially available gas oil fuels and/or biofuels.

The gas oil fuels may also be called diesel fuels.

Fuels based on bio-additives are also called biofuels.

The suitable fuels for applying the invention are not too limited, but are generally liquid at room temperature, for example from 20 to 30° C.

The liquid fuel may be a fuel of the hydrocarbon type, a fuel of a type other than a hydrocarbon, or one of their mixtures.

The fuel of the hydrocarbon type may be a petroleum distillate, notably a gasoline according to the definition given by the ASTM D4814 standard or a gas oil fuel according to the definition given by the ASTM D975 standard or the European standard EN590+A1.

In an embodiment, the liquid fuel is a gasoline, in another embodiment the liquid fuel is a lead-free gasoline.

In another embodiment, the liquid fuel is a gas oil fuel.

The fuel of the hydrocarbon type may be a hydrocarbon prepared by a method for transforming a gas into a liquid in order to include for example hydrocarbons prepared by a process such as the Fischer-Tropsch process.

In certain embodiments, the fuel applied in the present invention is a gas oil fuel, a gas oil biofuel or combinations thereof.

The fuel of the type other than a hydrocarbon may be a composition containing oxygen atoms, which is often called an oxygenation product, which comprises an alcohol, an ether, a ketone, an ester of a carboxylic acid, a nitroalkane, or one of their mixtures. The fuel of a type other than a hydrocarbon may for example comprise methanol, ethanol, methyl-t-butyl ether, methyl ethyl ketone, oils and/or trans-esterified fats of vegetable or animal origin such as rape seed methyl ester and soya methyl ester, and nitromethane.

The mixtures of fuels of the hydrocarbon type and of the type other than a hydrocarbon may comprise for example gasoline and methanol and/or ethanol, gas oil fuel and ethanol, and gas oil fuel and a trans-esterified vegetable oil such as rape seed methyl ester and other bio-derived fuels.

In an embodiment, the liquid fuel is a water emulsion in a fuel of the hydrocarbon type, a fuel of a type other than a hydrocarbon, or one of their mixtures.

In several embodiments of this invention, the liquid fuel may have a sulfur content, on a basis by weight, which is of 5,000 ppm or less, a 1,000 ppm or less, or 300 ppm or less, 200 ppm or less, 30 ppm or less or 10 ppm or less.

The liquid fuel of the invention is present in an additived fuel according to the invention in a major amount, i.e. generally greater than 95% by weight, and in other embodiments, it is present in an amount of more than 97% by weight, of more than 99.5% by weight or more than 99.9% by weight.

The fuels suitable for applying the present invention optionally comprise one or several additional performance additives, solvents or diluents. These performance additives may be of any type and for example allow improvement in the distribution of the fuel in the engine and/or the improvement of the performances of the operation of the engine and/or improvement in the stability of the operation of the engine.

As an example and without being limited, it is possible to mention antioxidants like sterically hindered phenol, detergent and/or dispersant additives such as nitrogen-containing detergents or succinimides or further agents improving cold flow such as an esterified copolymer of maleic anhydride and styrene.

The dispersion of the invention may be used for various applications.

In particular, mention may be made of applications where the magnetic properties of the particles of the dispersion according to the invention may advantageously be utilized.

Examples will now be given.

EXAMPLES

Example 1

Preparation of a Dispersion of Iron Particles in a Crystallized Form (According to the Invention)

Preparation of the Solution of Iron Precursors

A liter of solution is prepared in the following way: 576 g of $Fe(NO_3)_3$ are mixed with 99.4 g of $FeCl_2$, $4H_2O$. The mixture is completed with distilled water in order to obtain one liter of solution. The final concentration of this solution of iron precursors is 1.5 $mol \cdot L^{-1}$ of Fe.

Preparation of the Soda Solution

A 6 $mol \cdot L^{-1}$ NaOH solution is prepared in the following way: 240 g of soda tablets are diluted in distilled water in order to obtain one liter of solution.

Into a reactor of one liter equipped with a stirring system, a tank bottom is introduced, consisting of 400 ml of a solution of sodium nitrate $NaNO_3$ at 3 $mol \cdot L^{-1}$. The pH of the solution is adjusted to 13 by means of a few drops of soda at 6 mol/L. The formation of the precipitate is accomplished by simultaneous addition of the solution of iron precursors and of the soda solution prepared beforehand. The flow rates for introducing both of these reagents are adjusted so that the pH is maintained constant and equal to 13 at room temperature.

823.8 g of the solution obtained by precipitation (i.e. 21.75 g of an $Fe_2O_3$ equivalent or further 0.27 mol of Fe), neutralized beforehand, are redispersed in a solution containing 24.1 g of isostearic acid (Prisorine 3501, a cut provided by Croda) and 106.4 g of Isopar L. The suspension is introduced into a jacketed reactor equipped with a thermostated bath and provided with a stirrer. The reaction set is brought to 90° C. for 4 h.

After cooling, the mixture is transferred into a test tube. Demixing is observed and a 500 mL aqueous phase and a 100 mL organic phase are collected. This organic dispersion has an iron mass content of 10%, expressed in iron metal mass based on the total mass of the collected dispersion.

The obtained product is stable for at least one month of storage at room temperature, no decantation is observed.

Comparative Example 2

Preparation of a Dispersion of Iron Particles in the Crystallized Form (Non-Compliant with the Invention)

The same procedure as the one of Example 1 is followed, except for, before introducing the reagents in the tank bottom, the pH of the sodium nitrate solution is adjusted to 11 and during the formation of the precipitate, the flow rates for introducing the solution of iron precursors and the solution of soda are adjusted so that the pH is maintained constant and equal to 11 at room temperature.

Comparative Example 3

Preparation of a Dispersion of Iron Particles in the Amorphous Form

Preparation of an Iron Acetate Solution 412.2 g of $Fe(NO_3)_3.5H_2O$ at 98% are introduced into a beaker and distilled water is added thereto up to a volume of 2 liters. The solution is a 0.5M Fe solution. 650 mL of 10% ammonia are added dropwise with stirring and at room temperature, in order to obtain a pH of 7.

The mixture is centrifuged for 10 minutes at 4,500 rpm and then the mother waters are removed. The solid is resuspended in distilled water to a total volume of 2,650 mL. The mixture is stirred for 10 mins, and then centrifuged for 10 mins at 4,500 rpm. The mother waters are removed and the solid is resuspended in distilled water to a total volume of 2,650 mL. Stirring is left for 30 mins. 206 mL of concentrated acetic acid are then added. Stirring is left overnight. The obtained iron acetate solution is limpid.

The formation of the precipitate is then achieved in a continuous assembly comprising:

- a reactor of one liter equipped with a stirrer with blades with an initial tank bottom consisting of 500 mL of distilled water, this reaction volume being kept constant by means of an overflow; and
- two supply flasks containing the iron acetate solution prepared beforehand on the one hand and a 10% ammonia solution on the other hand.

The iron acetate solution and the 10% ammonia solution are added together. The flow rates of both solutions are set so that the pH is maintained constant and equal to 8.

The obtained precipitate is separated from the mother waters by centrifugation at 4,500 rpm for 10 mins. 95.5 g of hydrate are collected with 21.5% of dry extract (i.e. 20.0 g of equivalent $Fe_2O_3$ or 0.25 mol of Fe) and are then redispersed in a solution containing 39.2 g of isostearic acid in 80.8 g of Isopar L. The suspension is introduced into a jacketed reactor equipped with a thermostatic bath and provided with a stirrer. The reaction set is brought to 90° C. for 5 h 30 mins.

After cooling, it is transferred into a test tube. Demixing is observed and a 50 mL aqueous phase and a 220 mL organic phase are collected. The collected organic dispersion has a 10% iron mass content, expressed as a mass of iron metal relatively to the total mass of the collected dispersion.

Example 4

Characterization of the Iron Particle Dispersions

Example 4.1

X-Ray Diffraction (XRD)

The XRD analysis was carried out according to the indications given in the description.

It is seen that the peaks of the diffractograms of the dispersion of Example 1 and of the dispersion of Example 2 actually correspond to the diffraction peaks XRD characteristics of the crystallized magnetite and/or maghemite phase (sheet ICDD 01-088-0315).

The diffractogram of the dispersion of Example 3 does not show any significant XRD peak, which allows the conclusion to be drawn that the iron phase is in an amorphous form.

The calculation of the crystallite size according to the method shown earlier leads to crystallite sizes of 4 nm for Example 1 which are compliant and 9 nm for Example 2 which are non-compliant, respectively.

Example 4.2

Transmission Electron Microscopy (TEM)

Analysis by TEM was carried out according to the indications given in the description.

The characteristics from this TEM counting: percentage of particles less than 7 nm, Φ50, polydispersity $P_n$ are reported in Table 1.

TABLE 1

| | % of particles <7 nm | $\Phi_{50}$ (nm) | $P_n$ |
|---|---|---|---|
| Example 1 | 95% | 3.8 nm | 0.35 |
| Example 2 | 72% | 5.7 nm | 0.35 |
| Example 3 | 98% | 3.5 nm | 0.22 |

Example 4.3

Dynamic Light Scattering (DLS)

DLS analysis was carried out according to the indications given in the description.

The average hydrodynamic diameters $P_h$ in intensity are reported in Table 2.

TABLE 2

| | $D_h$ |
|---|---|
| Example 1 | 11.6 |
| Example 2 | 22 |
| Example 3 | 13.5 |

Example 5

Compatibility of the Dispersions of the Iron Particles with Gas Oil Fuels

An additived fuel is prepared in order to measure the compatibility of the dispersions according to the invention with said fuel.

For this, a certain amount of dispersion is added to the fuel in order to attain a iron metal mass concentration of 7 ppm in the fuel. The fuel used here is a fuel containing approximately 11% by mass of biofuel (fatty acid methyl ester or FAME) (Table 3).

TABLE 3

Main characteristics of the B10 fuel

| Fuel Composition | | B10 |
|---|---|---|
| Aromatic | % mass | 24 |
| Polyaromatic | % mass | 4 |
| FAME | % volume/volume | 10.8 |
| Sulfur | mg/kg | 5 |
| Carbon residue (on the 10% distillation residue) | % mass/% mass | <0.2 |
| Copper | mg/kg | 0 |
| Zinc | mg/kg | 0 |

The test is based on the NF EN 15751 standard (Fuels for automobiles—Fatty acid methyl esters (FAME) and mixed with gas oil—Determination of the oxidation stability by an accelerated oxidation method).

For this test, a dry air flow (10 L/h) bubbles in 7.5 g of the fuel heated to 110° C. The vapors produced during the oxidation process are carried away by the air into a cell containing demineralized water and an electrode measuring the conductivity of water. This electrode is connected to a measurement and recording system. This system indicates the end of the induction period when the conductivity of water increases rapidly. This rapid increase in the conductivity is caused by solubilization in the water of volatile carboxylic acids formed during the oxidation process of the fuel.

Table 4 shows that the degradation of the fuel is very low when a dispersion of iron particles in the crystallized form is used, induction times close to 33-35 h are measured for a fuel additive with the dispersion of Example 1 (particles in crystallized form, 4 nm size), and for a fuel additive with the dispersion of Example 2 (particles in crystallized form, 9 nm size).

Conversely, the induction time of a fuel additive with the dispersion of Example 32 (particles in amorphous form) leads to a greater degradation, the induction time under these conditions dropping down to 19.8 h.

TABLE 4

Induction time

| | Induction time (h) |
|---|---|
| Fuel additive with the dispersion of Example 1 | 33.5 |
| Fuel additive with the dispersion of Example 2 | 35.6 |
| Fuel additive with the dispersion of Example 3 | 19.8 |

Example 6

Engine Test for Regenerating a Particle Filter

The efficiency of the dispersion described in the previous examples for regenerating a particle filter (PF) was measured through engine tests for regenerating PF. For this, a diesel engine provided by the Volkswagen group (4 cylinders, 2 liters, turbo compressor with air cooling, 81 kW) was used on an engine test bench.

The exhaust line mounted downstream is a commercial line consisting of an oxidation catalyst containing a washcoat based on platinum and alumina followed by an PF in silicon carbide (PF: total volume 2.52 L, diameter 5.66 inches, length 5.87 inches).

The fuel used is a commercial fuel fitting the EN590 DIN 51628 standard containing less than 10 ppm of sulfur and containing 7% by volume of FAME.

For these tests, the fuel is additived with different dispersions of Examples 1, 2 and 3. The added content is adjusted so as to add into the fuel an amount of dispersion corresponding to 5 ppm by weight (Examples 1 and 3) or 7 ppm by weight (Example 2) of iron expressed in the form of iron metal based on the total mass of fuel. As a comparison, a fourth test was conducted with the same fuel but not additived with a dispersion.

The test is conducted in two successive steps: a step for loading the PF, followed by a step for regenerating the latter. The conditions of both of these steps are strictly identical for the four tests, except for the fuel used (either additived or not).

The loading phase is carried out by operating the engine at a speed of 3,000 revolutions/minute (rpm) and by using a torque of 45 Nm for approximately 6 hours. This loading phase is stopped when 12 g of particulate phase are loaded in the PF. During this phase the temperature of the gas upstream from the PF is from 230 to 235° C. Under these conditions, the emissions of particles are of about 2 g/h.

After this loading phase, the PF is disassembled and weighed in order to check the mass of loaded particles during this phase (amount of particulate phase in the PF after loading, of Table 5).

The PF is then reassembled on the bench and heated by the engine which is put back for 30 minutes under the operating conditions of the loading (3,000 rpm/45 Nm).

The conditions of the engine are then modified (torque 80 Nm/2,000 rpm) and post injection is requested to the central electronic unit of the engine (ECU) which allows the temperature to be raised upstream from the PF to 450° C. and starting the regeneration of the PF. These conditions are maintained for 35 minutes (2,100 seconds), this time being counted from the starting of the post injection.

The PF regeneration efficiency is measured through two parameters:

the % of burned soot, which corresponds to the combustion rate of soots calculated at each instant t according to the reduction in the pressure drop ΔP(t):

$$\%\ \text{burnt soots} = \frac{\Delta P(\text{beginning of regeneration}) - \Delta P(t)}{\Delta P(\text{beginning of regeneration})} \times 100$$

100% of burnt soots corresponding to the stabilization of the pressure drop to the lowest level observed under these conditions with an PF not containing any soots. In the case of the tests conducted with the additived fuel, the pressure drop stabilizes before the end of the regeneration test which gives the possibility of calculating this criterion. In the case of the test with the non-additived fuel, the pressure drop remains high and is not stabilized which does not allow this criterion to be calculated.

the mass of burnt particles during regeneration, calculated from the weighing operations of the PF before loading, after loading and at the end of the regeneration.

Generally, the higher these parameters, the more the regeneration is efficient.

The results are grouped in Table 5.

TABLE 5

| Presence of an additive in the fuel | none | Ex. 1 | Ex. 2 | Ex. 3 |
|---|---|---|---|---|
| Iron content in the fuel (ppm by weight of Fe) | 0 | 5 | 7 | 5 |
| Amount of particulate phase in the PF after loading (g) | 12.2 | 12.0 | 12.4 | 12.1 |
| Amount of iron in the PF resulting from the additive (g)* | 0 | 0.12 | 0.18 | 0.13 |
| Particles burnt during the regeneration (35 minutes) (g) | 2.2 | 11.5 | 12.0 | 11.4 |
| Particles burnt during the regeneration (35 minutes) (%) | 18 | 96 | 97 | 94 |
| Pressure drop at the beginning of the regeneration (mbars) | 87.1 | 85.9 | 82.1 | 86.9 |
| Pressure drop after 35 minutes at 450° C. (mbars) | 65.6 | 30.3 | 30.4 | 31.0 |
| % of burnt soots after 5 minutes of regeneration | — | 45.9 | 43.4 | 45.5 |
| % of burnt soots after 10 minutes of regeneration | — | 83.7 | 82.8 | 83.1 |
| % of burnt soots after 15 minutes of regeneration | — | 95.0 | 95.3 | 96.0 |
| % of burnt soots after 20 minutes of regeneration | — | 98.1 | 98.7 | 99.1 |
| % of burnt soots after 35 minutes of regeneration | — | 100 | 100 | 100 |

*calculated considering a loading of the PF for 6 hours with a fuel consumption of 4 kg/h It is seen that the presence of an additive in the fuel gives the possibility of obtaining regeneration of the PF at 450° C. since 94 to 97% of the soots are burnt after 35 minutes at 450° C. while in the absence of any additive, only 18% of the soots are burnt. The same applies if the pressure drop is observed on the PF, which is more greatly reduced in the presence of an additive: in both cases it drops by about 85 mbars to about 30 mbars while without any additive the pressure drops after 35 minutes at 450° C., remains greater than 65 mbars expressing non-complete regeneration.

When the dispersions are compared, it is seen that the dispersion of Example 1 (dispersion of 4 nm crystallized particles) leads to regeneration kinetics close to those of Example 3 (dispersion of amorphous particles) and this for a low dosage corresponding to 5 ppm by weight of iron. Conversely, in order to have the same kinetics of the dispersion of Example 2 (dispersion of 9 nm crystallized particles), the additive amount has to be increased and attain the equivalent of 7 ppm by weight of iron metal in the fuel which demonstrates the lower efficiency of dispersions with crystallized particles of great size.

The whole of the Examples illustrates that the dispersions of crystallized particles of magnetite and/or maghemite of small size (here 4 nm) may be very efficient at a low dosage while not notably degrading the fuel.

The invention claimed is:

1. A dispersion comprising:

an apolar organic phase;

at least one amphiphilic agent selected from the group consisting of fatty acids of tallol, soya bean, tallow oil, flax oil, oleic acid, linoleic acid, stearic acid and its isomers, pelargonic acid, capric acid, lauric acid, myristic acid, dodecylbenzenesulfonic acid, ethyl-2-hexanoic acid, naphthenic acid and hexanoic acid, thus stabilizing the dispersion; and solid objects dispersed in the organic phase in the form of individualized particles or aggregates of particles, consisting of an iron compound in crystallized form, wherein:

said objects have a hydrodynamic diameter $D_h$ of less than or equal to 30 nm as measured by dynamic light scattering;

said particles have an average size $\overline{D}_{XRD}$ of less than or equal to 7 nm measured by X-ray diffraction; and at least 80% by number of said particles have a size $D_{TEM}$ of less than or equal to 7 nm measured by transmission electron microscopy.

2. The dispersion according to claim 1, wherein the particles have an average size $\overline{D}_{XRD}$ of less than or equal to 6 nm.

3. The dispersion according to claim 1, wherein the particles have a size $D_{TEM}$ of less than or equal to 6 nm.

4. The dispersion according to claim 1, wherein the particles have a median diameter $\Phi_{50}$ comprised from 2 nm to 6 nm.

5. The dispersion according to claim 1, further comprising particles of an iron compound in amorphous form.

6. The dispersion according to claim 1, wherein the apolar organic phase is based on an apolar hydrocarbon or a mixture of apolar hydrocarbons.

7. The dispersion according to claim 1, wherein the amphiphilic agent is a carboxylic acid including from 10 to 25 carbon atoms.

8. The dispersion according to claim 1, wherein the mass concentration of the iron compound is greater than or equal to 2%.

9. The dispersion according to claim 1, wherein the molar ratio between the number of moles of amphiphilic agent and the number of iron moles is comprised from 0.2 to 1.

10. A method for preparing the dispersion according to claim 1, comprising the following steps:

a) putting into contact in an aqueous phase a base and a mixture comprising a Fe(II) salt and a Fe(III) salt, according to a molar ratio Fe(II)/Fe(III) of from 0.45 to 0.55, and maintaining the pH of the aqueous phase to a pH value of more than 11.5, whereby a precipitate is obtained; and b) putting into contact the obtained precipitate with an organic phase based on an apolar solvent, in the presence of an amphiphilic agent, whereby the dispersion in an organic phase is obtained.

11. The method according to claim 10, wherein during step a), the pH of the reaction medium is maintained at a value greater than or equal to 12.

12. The method according to claim 10, comprising, after step a) and before step b), a step of separating the precipitate formed at the end of step a) from the aqueous phase.

13. Fuel additive for internal combustion engines consisting of the dispersion according to claim 1.

14. A composition, comprising a fuel for internal combustion engines and the dispersion according to claim 1.

15. A fuel additive for internal combustion engines, consisting of a dispersion comprising:

an apolar organic phase;

one amphiphilic agent; and solid objects dispersed in the organic phase in the form of individualized particles or aggregates of particles, consisting of an iron compound in crystallized form, wherein:

said objects have a hydrodynamic diameter $D_h$ of less than or equal to 30 nm as measured by dynamic light scattering;

said particles have an average size $\overline{D}_{XRD}$ of less than or equal to 7 nm measured by X-ray diffraction; and at least 80% by number of said particles have a size $D_{TEM}$ of less than or equal to 7 nm measured by transmission electron microscopy.

16. The fuel additive according to claim 15, wherein the one amphiphilic agent is selected from the group consisting of: fatty acids of tallol, soya bean, tallow oil, flax oil, oleic acid, linoleic acid, stearic acid and its isomers, pelargonic acid, capric acid, lauric acid, myristic acid, dodecylbenzenesulfonic acid, ethyl-2-hexanoic acid, naphthenic acid, and hexanoic acid.

17. The dispersion according to claim 1, wherein the apolar organic phase comprises at least 95% by mass of an apolar solvent, based on total mass of the organic phase.

18. The dispersion according to claim 1, wherein the apolar organic phase comprises at least 95% by mass of an apolar hydrocarbon, based on total mass of the organic phase.

19. The dispersion according to claim 18, wherein the apolar hydrocarbon is one or more selected from the group consisting of hexane, heptane, octane, nonane, cyclohexane, cyclopentane, and cycloheptane.

* * * * *